US012643723B2

(12) United States Patent
Sreedhar et al.

(10) Patent No.: US 12,643,723 B2
(45) Date of Patent: Jun. 2, 2026

(54) SYSTEMS, DEVICES AND METHODS FOR STORING AND TRANSPORTING FAçADE PANELS

(71) Applicant: Ennova Facades Inc., Windsor (CA)

(72) Inventors: Ajay Sreedhar, Windsor (CA); Jhan Alexander, Windsor (CA); John Beadow, Windsor (CA); Michal Chlumecky, Windsor (CA)

(73) Assignee: Ennova Facades Inc., Windsor (CA)

( * ) Notice: Subject to any disclaimer, the term of this patent is extended or adjusted under 35 U.S.C. 154(b) by 50 days.

(21) Appl. No.: 18/505,604

(22) Filed: Nov. 9, 2023

(65) Prior Publication Data

US 2024/0190630 A1 Jun. 13, 2024

Related U.S. Application Data

(60) Provisional application No. 63/424,030, filed on Nov. 9, 2022.

(51) Int. Cl.

| | |
|---|---|
| ***B65D 57/00*** | (2006.01) |
| ***B65D 81/05*** | (2006.01) |
| ***B65D 85/48*** | (2006.01) |

(52) U.S. Cl.

CPC ..... *B65D 57/004* (2020.05); *B65D 81/055* (2013.01); *B65D 85/48* (2013.01); *B65D 2581/058* (2013.01)

(58) Field of Classification Search

CPC .... B65D 57/004; B65D 81/055; B65D 85/48; B65D 2581/058; B65D 81/056

USPC ..... 206/453, 586, 509, 511, 512, 449, 455, 206/454, 599, 821

See application file for complete search history.

(56) References Cited

U.S. PATENT DOCUMENTS

| | | | | |
|---|---|---|---|---|
| 1,690,824 | A * | 11/1928 | Kondolf | B65D 5/68 217/69 |
| 3,446,345 | A | 5/1969 | Frosoy | |
| 4,148,394 | A * | 4/1979 | Bederman | B65D 71/0092 206/599 |
| 4,951,821 | A | 8/1990 | Kempkes | |
| 6,368,694 | B1 * | 4/2002 | Marsh | B65D 81/055 229/199 |
| 8,109,393 | B2 | 2/2012 | Haeberlein | |

(Continued)

FOREIGN PATENT DOCUMENTS

EP 0270512 A2 8/1988

*Primary Examiner* — Rafael A Ortiz
*Assistant Examiner* — Jenine Spicer
(74) *Attorney, Agent, or Firm* — Smart & Biggar LP

(57) ABSTRACT

Systems, devices and methods of storing and transporting façade panels are described herein. The systems include a corner block that includes a vertical wall having a first portion and a second portion. The second portion is orthogonal to the first portion and attached to the first portion at a joint. Each of the first portion and the second portion have a receiver at an uppermost edge thereof to receive a lowermost edge of an adjacent corner block. The corner block also includes a support plate. The support plate is orthogonal to the first portion and the second portion. The support plate is spaced upwardly from a lowermost edge of the first portion and a lowermost edge of the second portion. The retainer of includes a first inner member that extends outwardly from the inner surface of the first portion to overhang at least a portion of the support plate.

20 Claims, 12 Drawing Sheets

(56) References Cited

U.S. PATENT DOCUMENTS

| | | | | |
|---|---|---|---|---|
| 8,844,719 | B2 | 9/2014 | Yoshida | |
| 8,905,234 | B2 | 12/2014 | Yoshida | |
| 8,991,602 | B2 * | 3/2015 | Kashima | B65D 85/30 211/49.1 |
| 9,889,980 | B2 * | 2/2018 | Shi | B65D 85/48 |
| 2006/0005875 | A1 | 1/2006 | Haberlein | |
| 2020/0317420 | A1 * | 10/2020 | Hashimoto | B65D 81/052 |
| 2023/0192384 | A1 * | 6/2023 | Clayton | B65D 81/056 206/586 |

* cited by examiner

SYSTEMS, DEVICES AND METHODS FOR STORING AND TRANSPORTING FAçADE PANELS

CROSS-REFERENCE

The present application claims priority to U.S. Provisional Patent Application No. 63/424,030, entitled Systems, Devices and Methods for Storing a Transporting Façade Panels, filed on Nov. 9, 2022, the entire contents of which are incorporated by reference herein for all purposes.

TECHNICAL FIELD

This disclosure relates generally to façade panels, and more specifically to systems, devices and methods for storing and transporting façade panels.

BACKGROUND

Recently there has been growing interest in using glass panels as exterior façade panels on large, oftentimes commercial, buildings.

Glass façade panels used in exterior applications commonly include uneven or jagged edges that either provide for the façade panels to be coupled together or for the façade panels to be mounted to a base of the building.

Due to the size, weight and cost of the façade panels, it is desirable to limit any damage to the façade panels that may be incurred during transportation, either within their manufacturing facility or during transport to their installation destination.

Corner blocks have been designed that protect the corners of façade panels, however, these corner blocks are cumbersome to apply and remove from the panels and do not provide for stacking panels on top of each other.

Accordingly, there is a need for improved systems, devices and methods for storing and transporting façade panels.

SUMMARY

In accordance with a broad aspect, a corner block for stacking façade panels is described herein. The corner block includes a vertical wall having a first portion and a second portion, the second portion being orthogonal to the first portion and attached to the first portion at a joint. The first portion and the second portion combine to provide the vertical wall with an L-shape. Each of the first portion and the second portion have a receiver at an uppermost edge thereof configured to receive a lowermost edge of an adjacent corner block. The corner block also includes a support plate orthogonal to the first portion and the second portion of the vertical wall. The support plate extends outwardly from an inner surface of the first portion and an inner surface of the second portion. The support plate is spaced upwardly from a lowermost edge of the first portion and the second portion. The retainer of the first portion includes a first inner member that extends outwardly from the inner surface of the first portion to overhang at least a portion of the support plate.

In at least one embodiment, the retainer of the second portion includes a second inner member that extends outwardly from the inner surface of the second portion to overhang at least a portion of the support plate.

In at least one embodiment, the receiver of the first portion includes the first inner member and a first outer member laterally spaced apart from the first inner member, each of the first inner member and the first outer member being attached to the first portion of the vertical wall.

In at least one embodiment, the receiver of the second portion includes the second inner member and a second outer member laterally spaced apart from the second inner member, each of the second inner member and the second outer member being attached to the second portion of the vertical wall.

In at least one embodiment, the first inner member has a height that is greater than a height of the first outer member.

In at least one embodiment, the second inner member has a height that is greater than a height of the second outer member.

In at least one embodiment, at least one of the first portion and the second portion include an inner cavity extending inwardly from an opening in the inner surface thereof, the inner cavity being positioned above the support plate and extending laterally from an outer edge of the first portion or the second portion of the vertical wall towards the joint.

In at least one embodiment, the inner cavity is shaped as a slot that is parallel with an upper surface of the support plate.

In at least one embodiment, the inner cavity is defined by an inner surface spaced apart from the opening and at least a portion of the inner cavity between the opening and the inner surface has a cavity height that is greater than a height of the opening.

In at least one embodiment, the first portion of the vertical wall includes a first inner cavity and the second portion of the vertical wall includes a second inner cavity, the first inner cavity extending inwardly from the inner surface of the first portion and the second inner cavity extending inwardly from the inner surface of the second portion, both of the first inner cavity and the second inner cavity being positioned above the support plate and extending laterally from an outer edge of the first portion and the second portion, respectively, towards the joint.

In at least one embodiment, at least one of the first portion and the second portion include a first outer cavity extending inwardly from a first opening in an outer surface thereof, the first outer cavity extending laterally from an outer edge of the first portion or the second portion of the vertical wall towards the joint.

In at least one embodiment, at least one of the first portion and the second portion include a second outer cavity extending inwardly from a second opening in an outer surface thereof, the second outer cavity extending laterally from an outer edge of the first portion or the second portion of the vertical wall towards the joint, the second outer cavity being vertically spaced apart from the first outer cavity.

In at least one embodiment, each of the first outer cavity and the second outer cavity is shaped as a slot that is parallel with an upper surface of the support plate.

In at least one embodiment, the first outer cavity is positioned above an upper surface of the support plate and the second outer cavity is positioned below the upper surface of the support plate.

In at least one embodiment, each of the first portion and the second portion include a first outer cavity extending inwardly from the first opening in the outer surface thereof and a second outer cavity extending inwardly from a second opening in the outer surface thereof, each of the first outer cavity and the second outer cavity extending laterally from an outer edge of the respective portion of the vertical wall towards the joint.

In at least one embodiment, at least one of the first portion and the second portion include a first protrusion extending outwardly from an outer surface thereof.

In at least one embodiment, the first portion includes a first protrusion extending outwardly from an outer surface of the first portion and the second portion includes a second protrusion extending outwardly from an outer surface of the second portion.

In at least one embodiment, each of the first protrusion is positioned between the first outer cavity and the second outer cavity of the first portion and the second protrusion is positioned between the first outer cavity and the second outer cavity of the second portion.

In accordance with another aspect, a system for stacking and/or transporting façade panels is described herein. The system includes a plurality of corner blocks as described in any one or more of the embodiments described herein, each of the corner blocks being positioned on a corner of a respective façade panel.

In at least one embodiment, the system includes a cap configured to releasably attach to a retainer of at least one of the corner blocks.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Figure 1A:
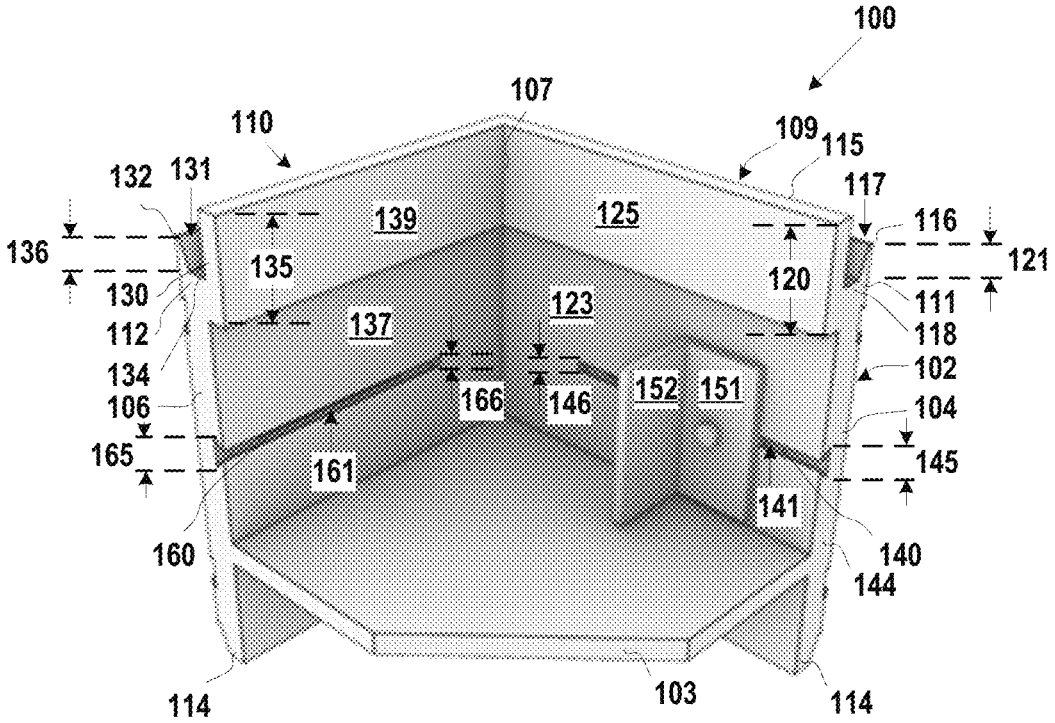
FIG. 1A is a front perspective view from above of a corner block for a façade panel, according to at least one embodiment described herein.

Further aspects and features of the example embodiments described herein will appear from the following description taken together with the accompanying drawings.

DESCRIPTION OF VARIOUS EMBODIMENTS

Various systems, devices and methods are described below to provide an example of at least one embodiment of the claimed subject matter. No embodiment described below limits any claimed subject matter and any claimed subject matter may cover systems, devices and methods that differ from those described below. The claimed subject matter are not limited to systems, devices and methods having all of the features of any one systems, device or method described below or to features common to multiple or all of the systems, devices and methods described below. It is possible that a system, device or method described below is not an embodiment of any claimed subject matter. Any subject matter that is disclosed in a system, device or method described herein that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

It should be noted that terms of degree such as "substantially", "about" and "approximately" as used herein mean a reasonable amount of deviation of the modified term such that the end result is not significantly changed. These terms of degree should be construed as including a deviation of the modified term, such as 1%, 2%, 5%, or 10%, for example, if this deviation does not negate the meaning of the term it modifies.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made, such as 1%, 2%, 5%, or 10%, for example, if the end result is not significantly changed.

The following description is not intended to limit or define any claimed or as yet unclaimed subject matter. Subject matter that may be claimed may reside in any combination or sub-combination of the elements or process steps disclosed in any part of this document including its claims and figures. Accordingly, it will be appreciated by a person skilled in the art that an apparatus, system or method disclosed in accordance with the teachings herein may embody any one or more of the features contained herein and that the features may be used in any particular combination or sub-combination that is physically feasible and realizable for its intended purpose.

Recently, there has been a growing interest in developing new systems, tools and methods for storing and transporting façade panels.

Figure 1B:
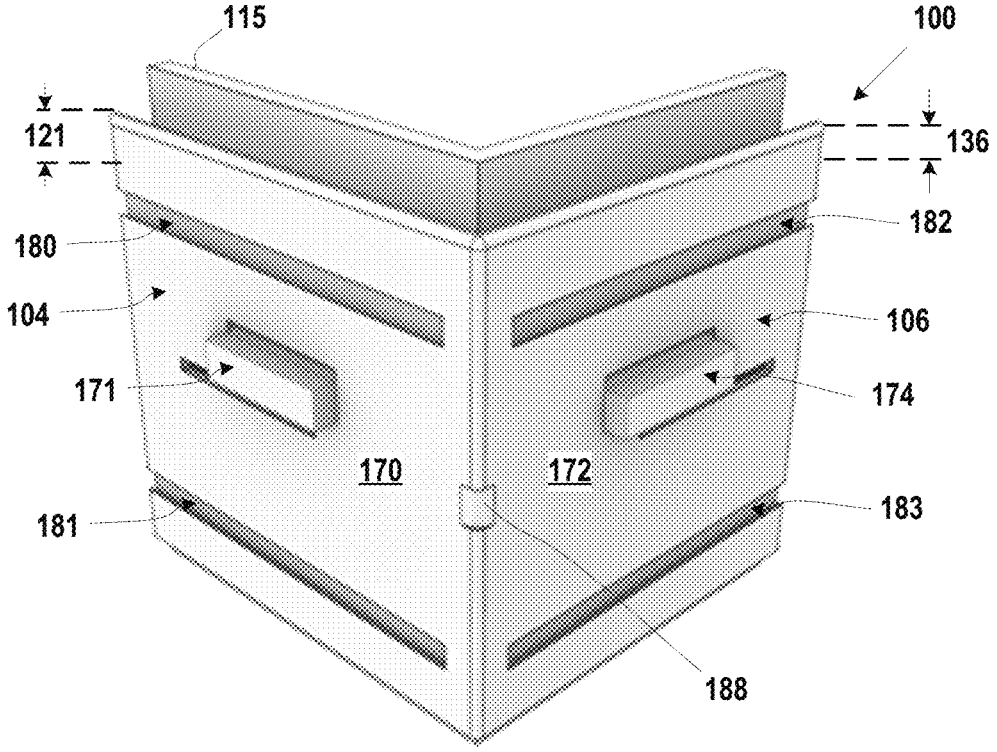
FIG. 1B is a rear perspective view from above of the corner block of FIG. 1A.
Figure 2A:
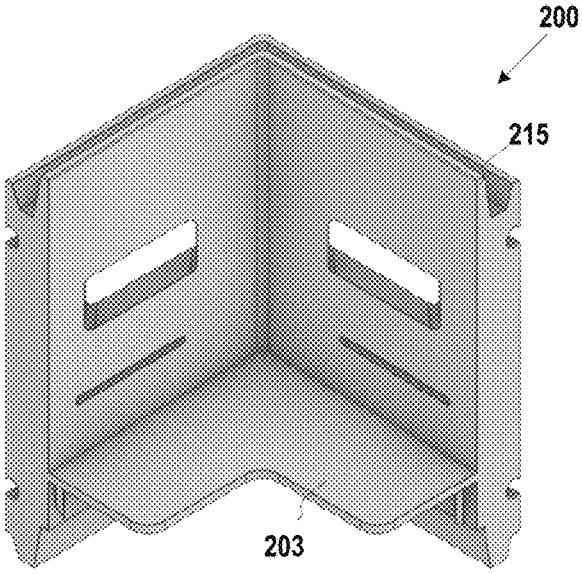
FIG. 2A is a front perspective view from above of a corner block for a façade panel, according to at least one embodiment described herein.
Figure 2B:
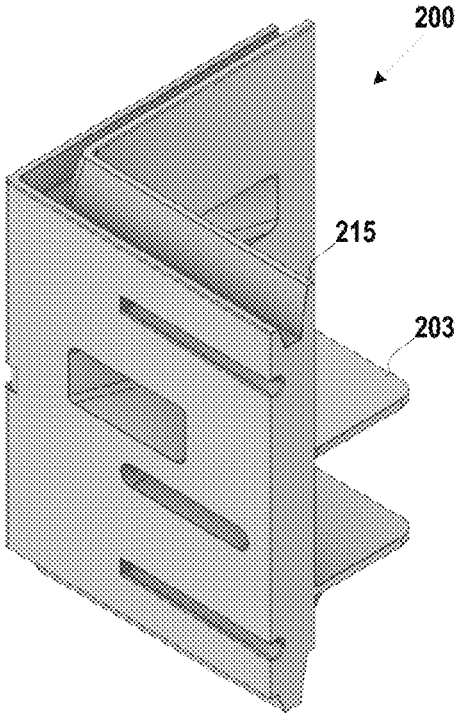
FIG. 2B is a left side perspective view from above of the corner block of FIG. 2A.
Figure 2C:
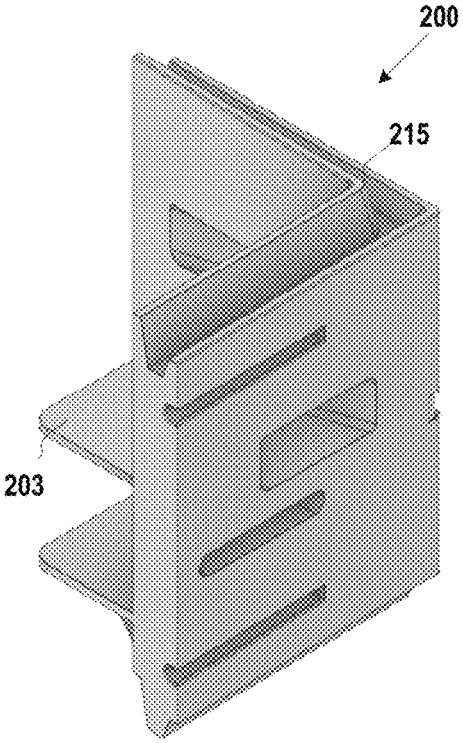
FIG. 2C is a right side perspective view from above of the corner block of FIG. 2A.
Figure 2D:
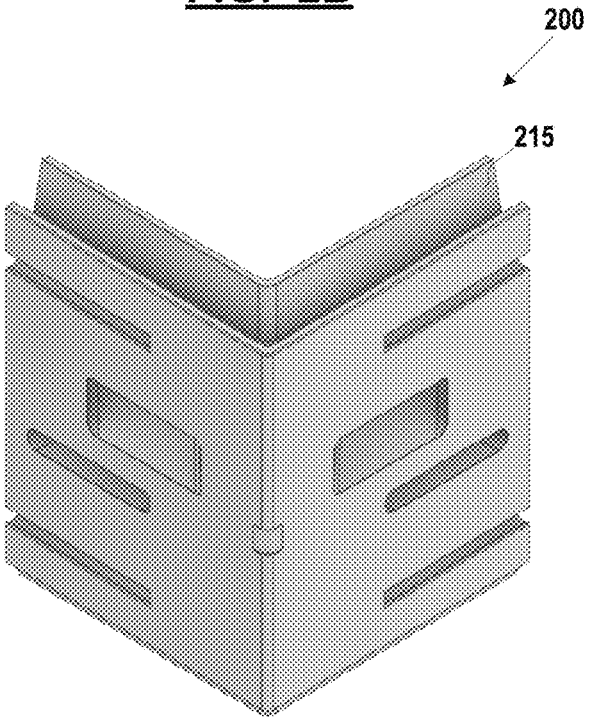
FIG. 2D is a rear perspective view from above of the corner block of FIG. 2A.

Reference is now made to FIGS. 1A and 1B, which show a front and rear perspective views from above, respectively, of a corner block 100 for storing and/or transporting a façade panel, such as but not limited to a glass panel for an exterior façade, according to at least one embodiment described herein. Corner block 100 includes a vertical wall 102 and support plate 103.

Corner block 100 may be made from any material known to one skilled in the art. For example, in some embodiments, corner block 100 may be made from a resin material, such as but not limited to a thermoplastic resin. In at least one embodiment, the thermoplastic resin may be a polyolefin resin (for instance, a polypropylene and/or a high-density polyethylene-based resin) or any other polyolefin resin having copolymers and/or homopolymers of olefin, such as but not limited to the ethylene, propylene, butane, pentane isoprene, and/or methyl pentene. In at least one embodiment, injection molding may be a suitable method for forming the corner block 100.

Returning to FIG. 1A, vertical wall 102 has a first vertical portion 104 and a second vertical portion 106. As shown in the drawings, first portion 104 is orthogonal to second portion 106 to provide vertical wall 102 with an L-shape formed by first portion 104 and second portion 106. First portion 104 and second portion 106 are upstanding and meet each other along a joint line 107. In some embodiments, first portion 104 and second portion 106 may be separate portions that are joined to each other. In other embodiments first portion 104 and second portion 106 may be integral with each other.

At least one of first portion 104 and second portion 106 includes a receiver 109 at an uppermost edge 111 thereof. In the embodiment shown in the drawings, first portion 104 includes a first receiver 109 and second portion 106 includes a second receiver 110, first receiver 109 being positioned at uppermost edge 111 of first portion 104 and second receiver 110 being positioned at uppermost edger 112 of second portion 106.

First receiver 109 and second receiver 110 co-operate to receive a lowermost edge 114 of another corner block 100 to provide for stacking a plurality of façade panels when a plurality of corner blocks 100 are stacked on top of each other and secured to each other during storage and/or transport. One example of façade panels having a plurality of corner blocks 100 being stacked on top of each other is shown in cross-section in FIGS. 3 and 4.

To receive the lowermost edge 114 of another corner block 100, first receiver 109 of first portion 104 includes a first inner member 115 and a first outer member 116 spaced apart from the first inner member 115. Between first inner member 115 and first outer member 116 is a receiving space 117 sized and shaped to receive at least a portion of lowermost edge 114. An upper surface 118 of uppermost edge 111 of first portion 104 forms a bottom portion of receiving space 117. First inner member 115 has a height 120 and first outer member 116 has a height 121. In the embodiment shown in the drawings, height 120 is greater than height 121. Further, in at least one embodiment, first inner member 115 extends outwardly from an inner surface 123 of first portion 104 to overhang at least a portion of the support plate 103. By overhanging at least a portion of support plate 103, inner surface 125 of first inner member 115 provides a surface for abutting at least a portion of façade panel 300.

Turning to FIGS. 2A to 2D, shown therein a corner block 300. For ease of understanding, like elements of FIGS. 1A and 1B have been numbered with like reference numbers used in FIGS. 2A, 2B, 2C and 2D with an increment of 100. In FIGS. 2A to 2D, it can be seen that first inner member 215 is bevelled (from a narrow top end to a thicker bottom end). Further, corner block 200 has a support plate 203 shaped to reduce the surface area of a top surface thereof while still providing for supporting a façade panel 300.

Figure 3:
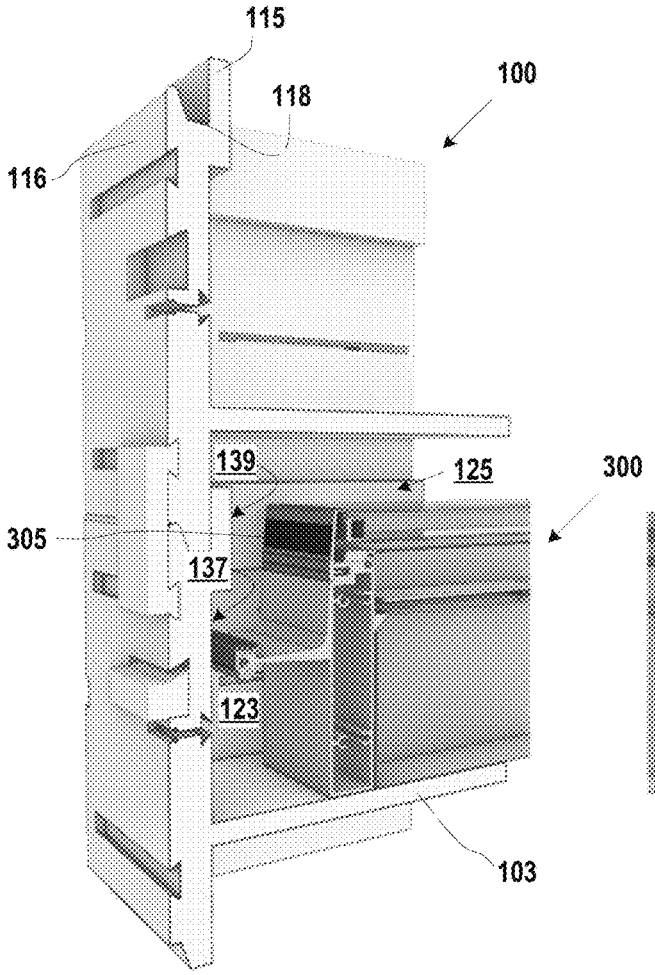
FIG. 3 is a side view of two corner blocks of FIG. 1 stacked on top of each other.
Figure 4:
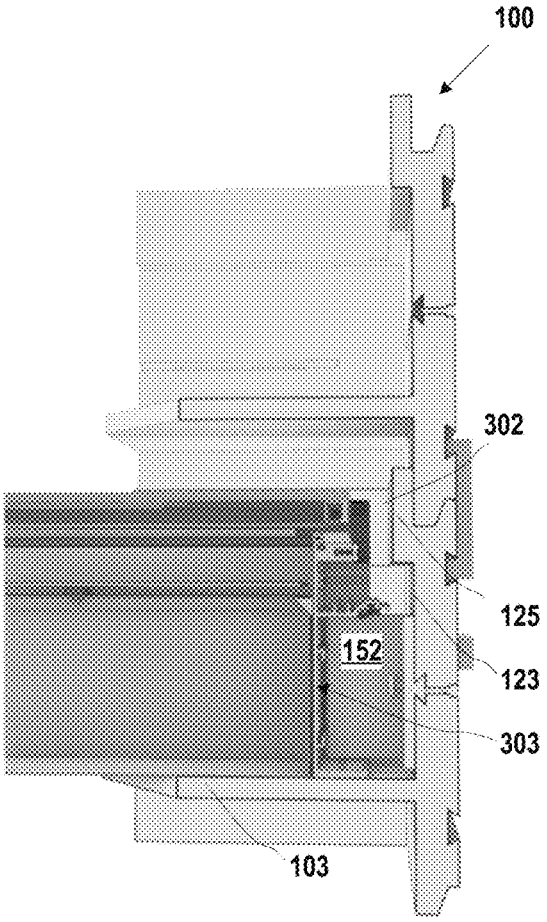
FIG. 4 is another side view of two corner blocks of FIG. 1 stacked on top of each other.

Referring to FIGS. 3 and 4, an upper portion 302 of façade panel 300 is shown abutting inner surface 125 of inner member 115. When this occurs, other portions and/or ridges forming outer edge 303 of façade panel 300 (e.g., below upper portion 302) are spaced apart from inner surface 123 of first inner member 115, thereby protecting the other portions and/or ridges forming outer edge 303 during storage and/or transport. By being spaced apart from inner surface 123 of first inner member 115, the other portions and/or ridges forming outer edge 303 of façade panel 300 are protected by corner block 100 and do not risk being damaged by impacting inner surface 123 during storage and/or transport.

Turning back to FIGS. 1 and 2, to receive the lowermost edge 114 of another corner block 100, receiver 110 of second portion 106 includes a second inner member 130 and a second outer member 132 spaced apart from the second inner member 130. Between second inner member 130 and second outer member 132 is a receiving space 131 sized and shaped to receive at least a portion of lowermost edge 114. An upper surface 134 of uppermost edge 112 of second portion 106 forms a bottom portion of receiving space 131. Second inner member 130 has a height 135 and second outer member 132 has a height 136. In the embodiment shown in the drawings, height 135 is greater than height 136. In the embodiment shown in the drawings, height 135 is the same as height 120 and the height 136 is the same as height 121. Further, in at least one embodiment, second inner member 130 extends outwardly from an inner surface 137 of second portion 106 to overhang at least a portion of the support plate 103. By overhanging at least a portion of support plate 103, inner surface 139 of second inner member 130 provides a surface for abutting at least a portion of façade panel 300. Referring to FIG. 3, an upper portion 305 of façade panel 300 is shown spaced apart from inner surface 139 of inner member 130.

Returning to FIG. 1, at least one of the first portion 104 and the second portion 106 of corner block 100 may optionally include an inner cavity extending inwardly from an opening in the inner surface thereof. For example, as shown in FIG. 1, first portion 104 includes and opening 140 in inner surface 123 that extends inwardly into first cavity 141 of first portion 104. First cavity 141 is positioned above the support plate 103 and extends laterally from an outer edge 144 of the first portion 104 towards the joint 107. In the embodiment shown in the drawings, the first cavity 141 has a height 145 that is greater than height 146 of opening 140. This may provide for a portion of an abutment device, such as but not limited to abutment device 150 shown in FIG. 1, to be releasably secured to first portion 104.

Figure 5A:
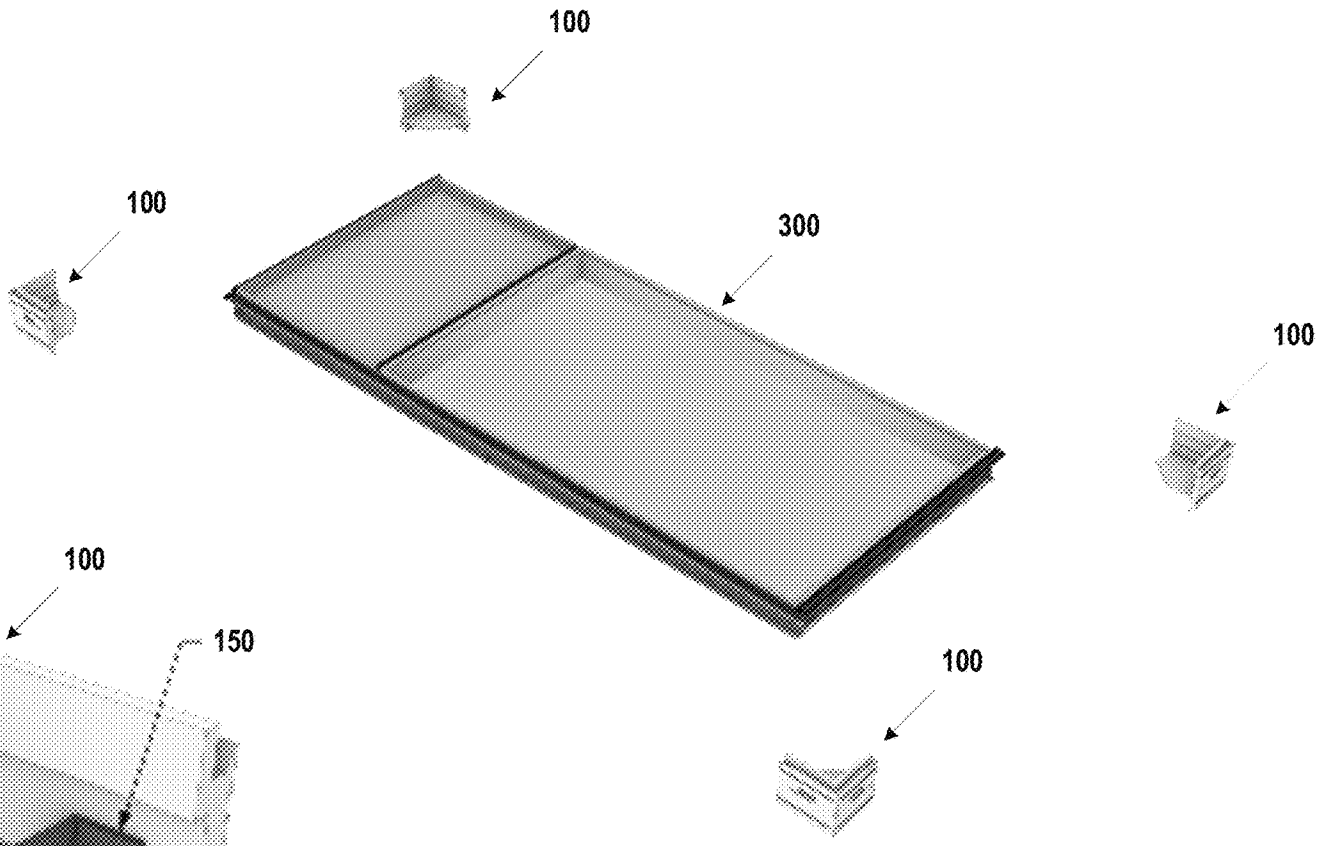
FIG. 5A is an exploded perspective view of a system for storing and transporting façade panels, according to at least one embodiment described herein.
Figure 5B:
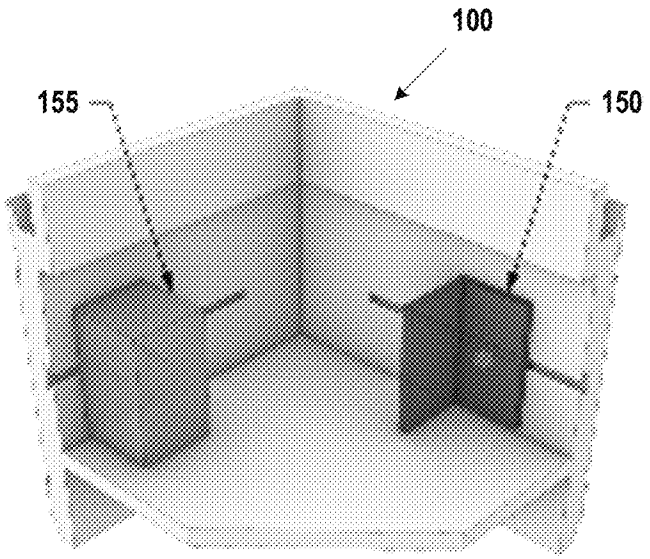
FIG. 5B is a front perspective view of a corner block of the system of FIG. 5A, according to at least one embodiment described herein.

Abutment device 150 is intended to slide along first cavity 141 and provide two abutment surfaces 151, 152, for supporting a façade panel such as façade panel 300. Abutment device has a protrusion 153 extending from a rear side thereof configured to be received in cavity 141. Protrusion 153 generally has a diameter that is greater than height 146 of opening 140 to retain the protrusion in the cavity 141. A second example of an Abutment device 155 is shown in FIG. 5B.150

As shown in FIG. 1, second portion 106 includes may optionally include second opening 160 in inner surface 137 that extends inwardly into second cavity 161 of second portion 106. Second cavity 161 is positioned above the support plate 103 and extends laterally from an outer edge 164 of the second portion 106 towards the joint 107. In the embodiment shown in the drawings, the second cavity 161 has a height 165 that is greater than height 166 of opening 160. This may provide for a portion of another abutment device (not shown) to be releasably secured to second portion 106. For example, the height 166 may be about 0.50 inches.

Returning to FIG. 1B, shown therein is a rear view of corner block 100. Protruding outwardly from a rear side 170 of first portion 104 of corner block 100 is a is a protrusion 171. Protrusion 171 is sized and shaped to receive a lifting element of a lifting bracket, such as but not limited to the lifting bracket 500 described below. Protrusion 171 is positioned between the upper slot 180 and lower slot 181, which are described in greater detail below.

Protruding outwardly from a rear side 172 of second portion 106 of corner block 100 is a is a protrusion 174. Protrusion 174 is sized and shaped to receive a lifting element of a lifting bracket, such as but not limited to the lifting bracket 500 described below. Protrusion 172 is positioned between the upper slot 182 and lower slot 183, which are described in greater detail below.

Figures 7A, 7B:
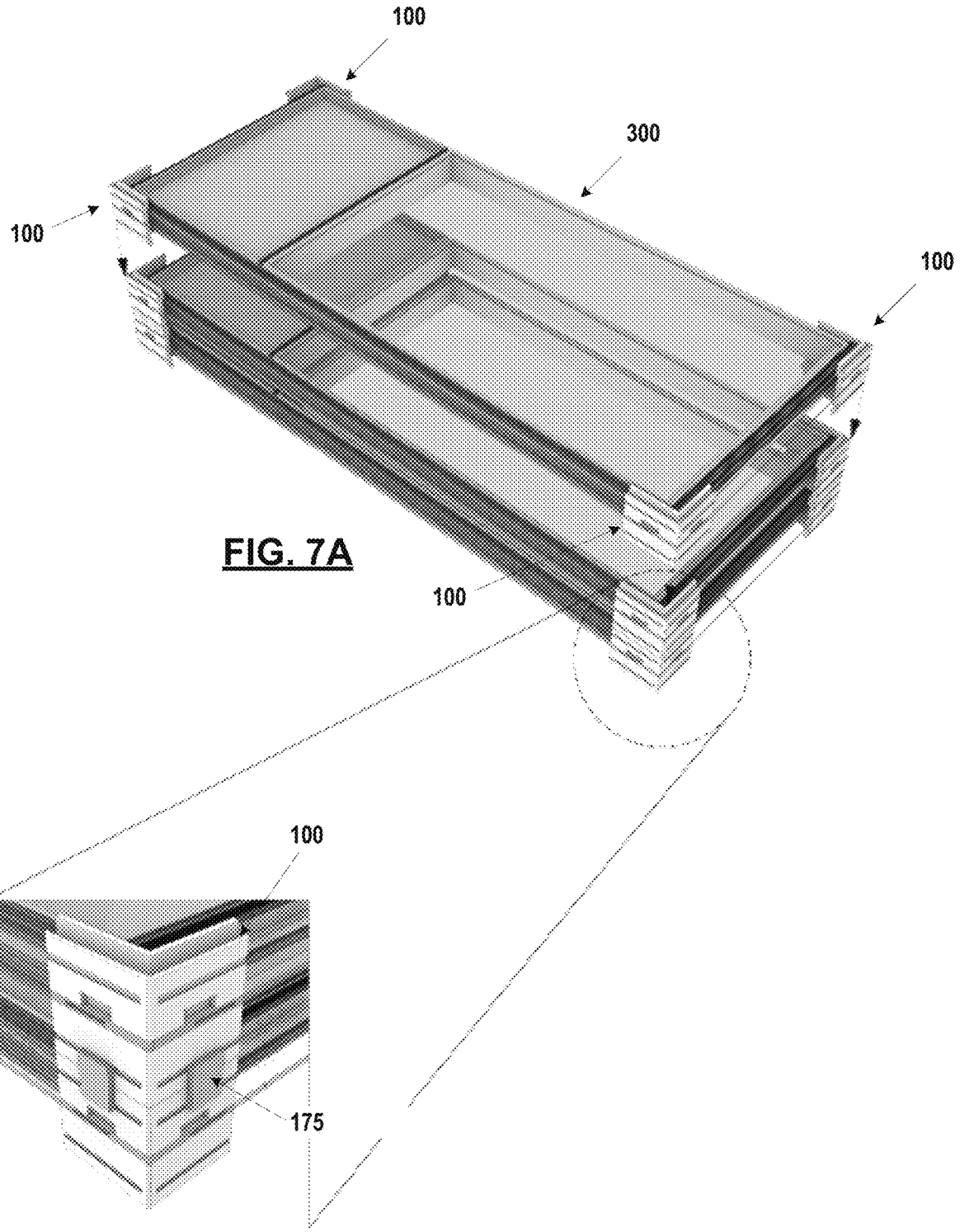
FIG. 7A is a perspective view of three systems of FIG. 6A stacked together.
FIG. 7B is a magnified view of a corner of the three stacked systems of FIG. 7A.

Rear side 170 of first portion 104 also includes a pair of slots 180, 181. Upper slot 180 and lower slot 181 are each sized and shaped to receive a retainer 175 (see FIG. 7A and FIG. 7B, for example) that is configured to enter an upper slot 180 and a lower slot 181 to hold two stacked corner blocks 100 together. An example of this is shown in FIGS. 7A and 7B as well as FIGS. 8A and 8B. In at least one embodiment, slots 180, 181 may be parallel with an upper surface 105 of the support plate 103.

Rear side 172 of second portion 106 also includes a pair of slots 182, 183. Upper slot 182 and lower slot 183 are each sized and shaped to receive a retainer 175 (see FIG. 7A and FIG. 7B, for example) that is configured to enter an upper slot 182 and a lower slot 183 to hold two stacked corner blocks 100 together. An example of this is shown in FIGS. 7A and 7B as well as FIGS. 8A and 8B. In at least one embodiment, slots 182, 183 may be parallel with an upper surface 105 of the support plate 103.

Figure 6A:
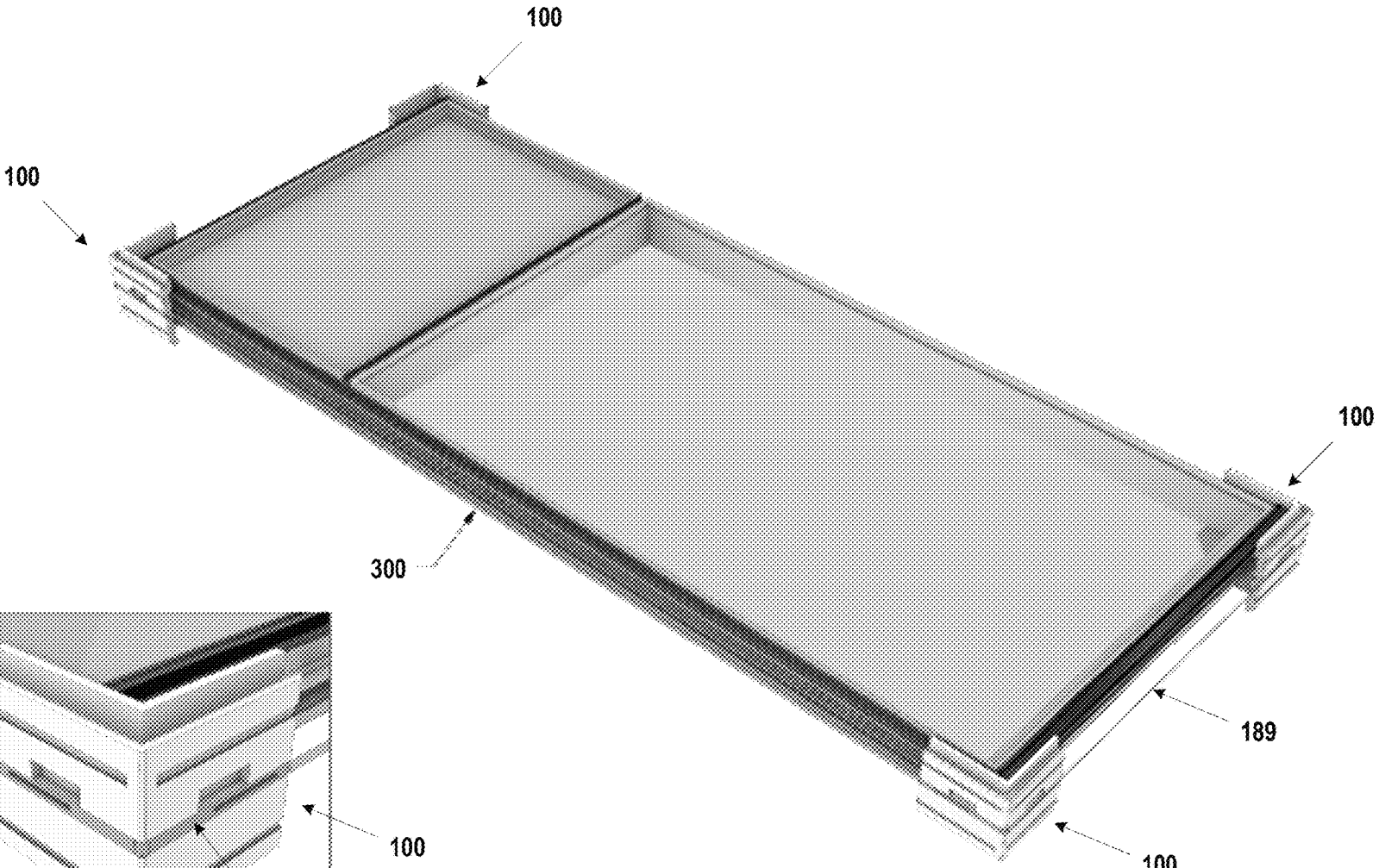
FIG. 6A is a perspective view from above of the system of FIG. 5A.
Figure 6B:
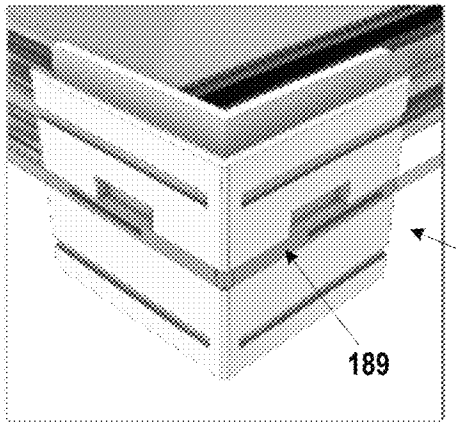
FIG. 6B is a magnified view of a portion of the assembled system of FIG. 6A.

In at least one embodiment, a rear side of joint 107 may include a groove 188 sized and shaped to retainer a fastening strap 189 that is used to retain corner block 100 on a corner of a façade panel 300. An example of fastening strap 189 is shown in FIGS. 6A and 6B, Turning now to FIGS. 7A and 7B, shown therein is a perspective view of three systems for stacking a façade panels. Façade panel 300 is shown with four corner blocks 100, each positioned on a corner thereof. As noted above, in this example, each corner block 100 of the façade panel 300 is retained thereon by a fastening strap 189. In FIG. 7A, three façade panels 300, each having four corner blocks 100, are shown therein. of FIG. 6A stacked together. FIG. 7B shows is a magnified view of a corner two of the stacked systems of FIG. 7A, where a retainer 175 has been positioned on two stacked corner blocks 100 to hold them together.

Figure 8A:
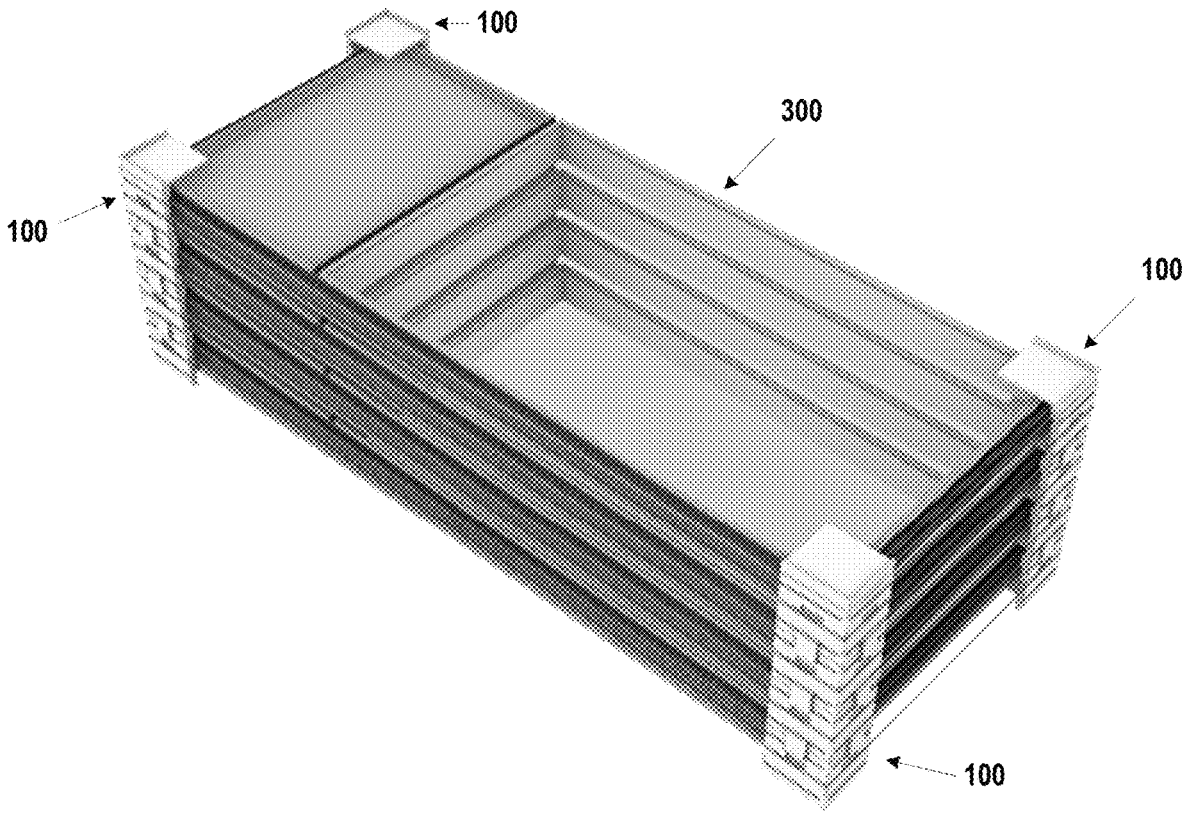
FIG. 8A is a perspective view of four systems of FIG. 6A stacked together.

FIG. 8A is a perspective view of four systems of stacked façade panels 300. Generally, its contemplated herein that four corner blocks 100 may be stacked on top of each other, such as is shown in FIG. 8A. However, it should be understood that more than four corner blocks 100 may be stacked on top of each other, particularly if the object on which the corner blocks 100 are applied is lighter than a standard façade panel 300, such as the one shown in the drawings.

Figure 8B:
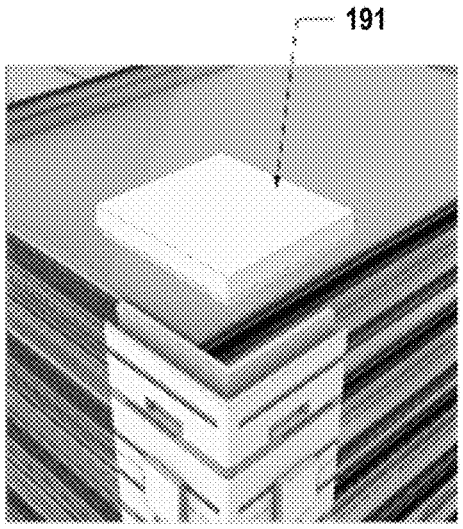
FIG. 8B is a magnified view of a corner of the four stacked systems of FIG. 8A showing a cap according to at least one embodiment described herein.
Figure 8C:
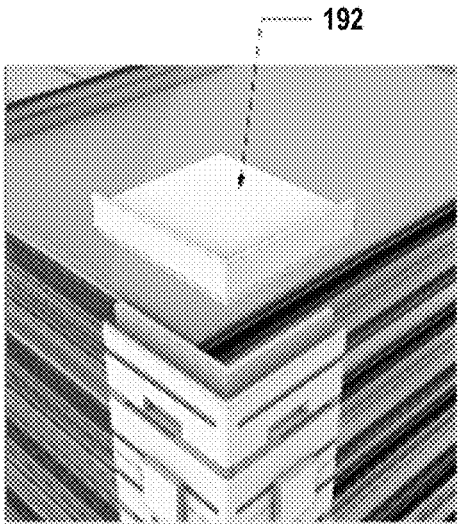
FIG. 8C is a magnified view of another corner of the four stacked systems of FIG. 8A showing a cap according to at least one embodiment described herein.

FIG. 8B shows a magnified view of one of the corners of the stack of façade panels 300 of FIG. 8A. In FIGS. 8B, a cap 191 is shown. Cap 191 is configured to be releasably secured to receivers 109, 110 of corner block 100. Cap 191 may be used to provide a flat surface for stacking additional materials on the stack of façade panels. FIG. 8C shows another embodiment of a cap 192. In this embodiment, cap 192 may provide for stacking additional stacks of façade panels on top of the stack of façade panels shown in FIG. 8A, for example.

FIG. 8C is a magnified view of another corner of the four stacked systems of FIG. 8A showing a cap according to at least one embodiment described herein.

Figure 9A:
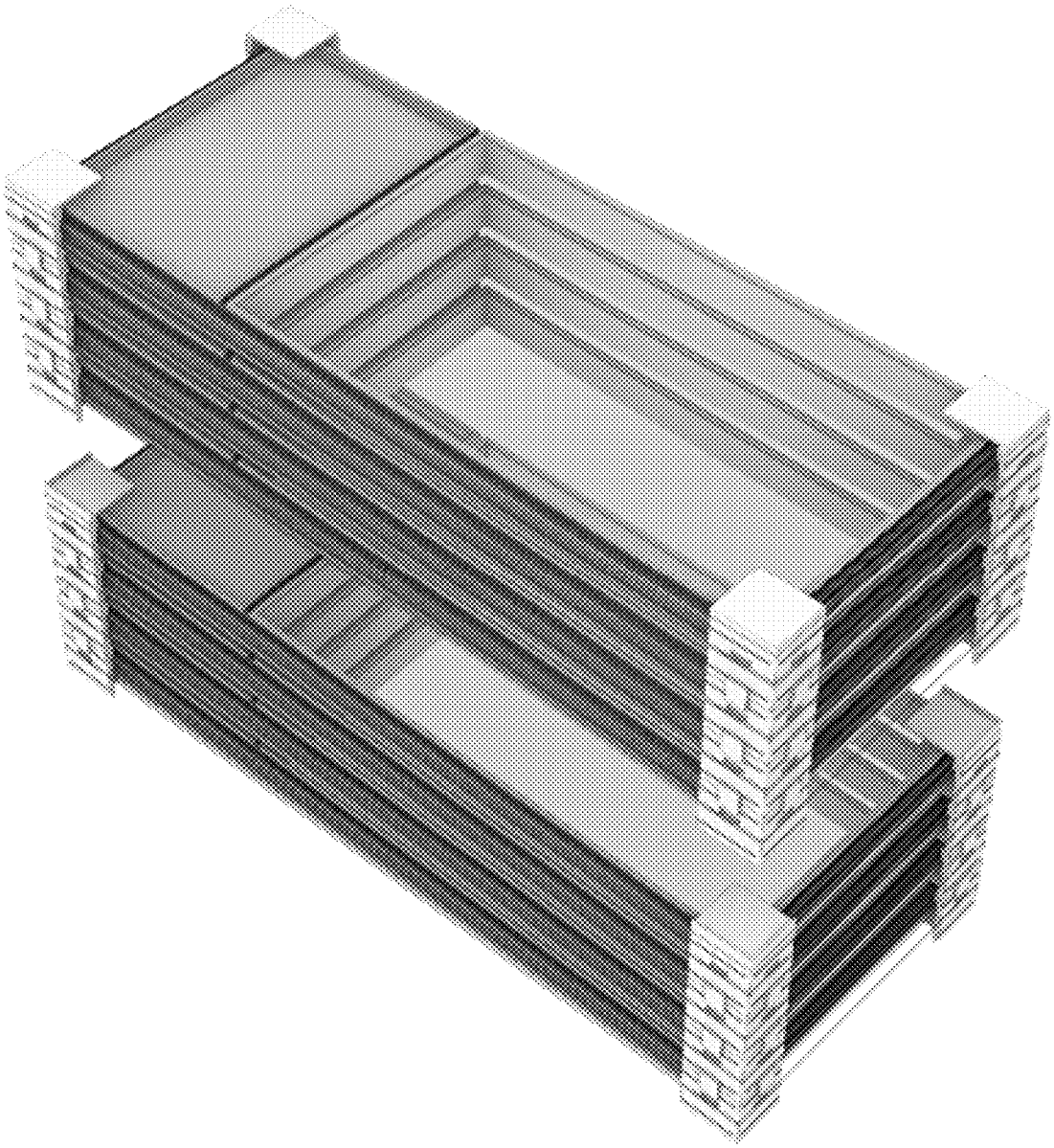
FIG. 9A is a perspective view of two bundles of four systems of FIG. 6A.
Figure 9B:
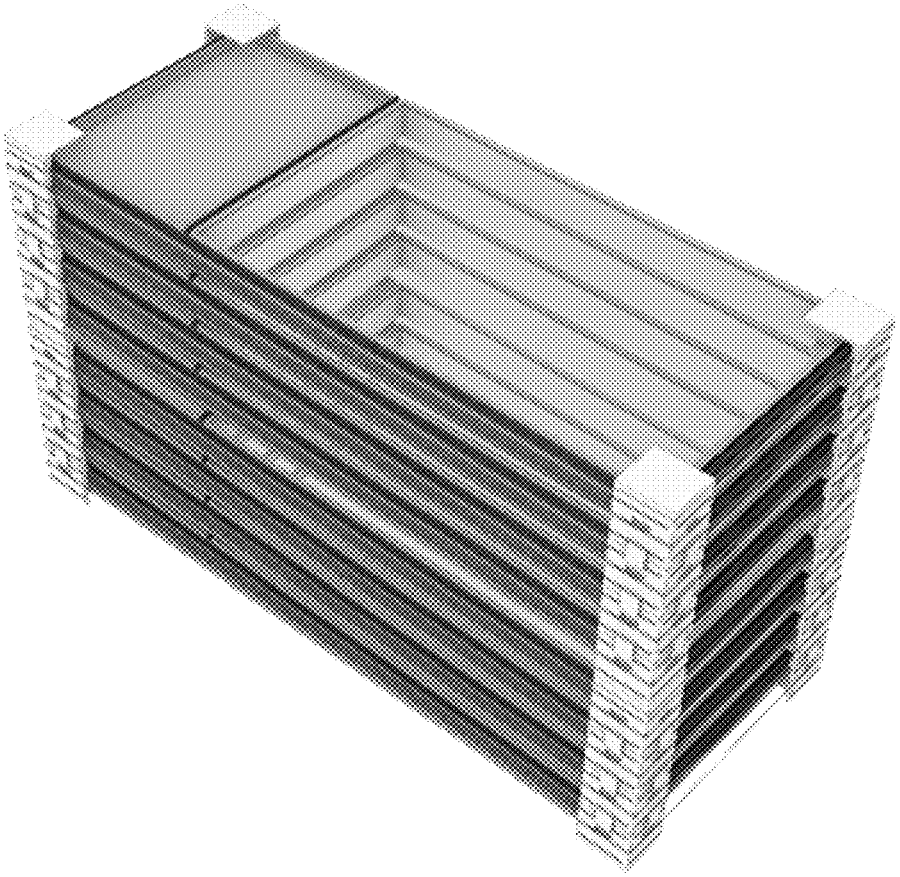
FIG. 9B is a perspective view of two bundles of four systems of FIG. 6A stacked together.
Figure 9C:
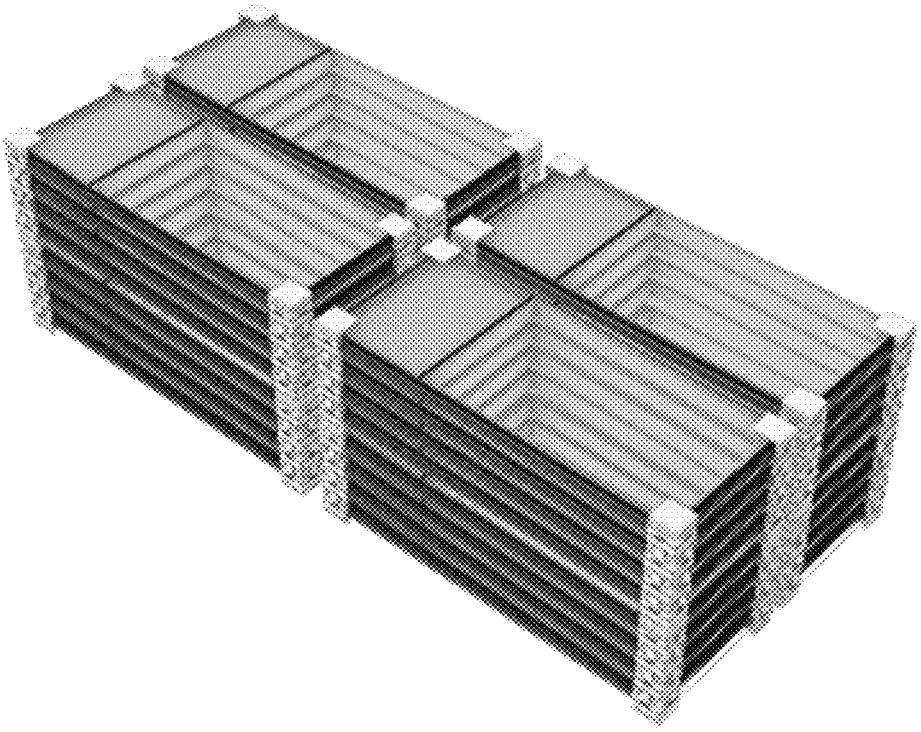
FIG. 9C is a perspective view of four groups of two bundles of four systems of FIG. 6A stacked together.

FIG. 9A is a perspective view of two bundles of four systems of stacked façade panels. Herein, each bundle includes a cap 191, as described above. FIG. 9B shows the two bundles of FIG. 9A stacked together. FIG. 9C shows how eight bundles of four systems may be arranged, such as for example in the back of a truck for transporting.

Figure 10A:
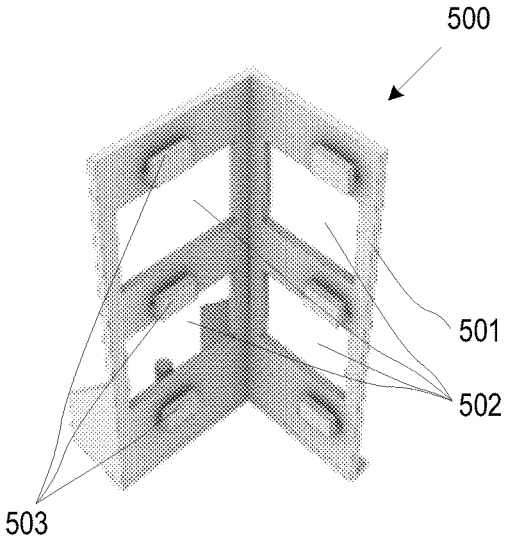
FIG. 10A is a front perspective view of a lifting bracket for use with the systems for storing and transporting façade panels described herein, according to at least one embodiment described herein.
Figure 10B:
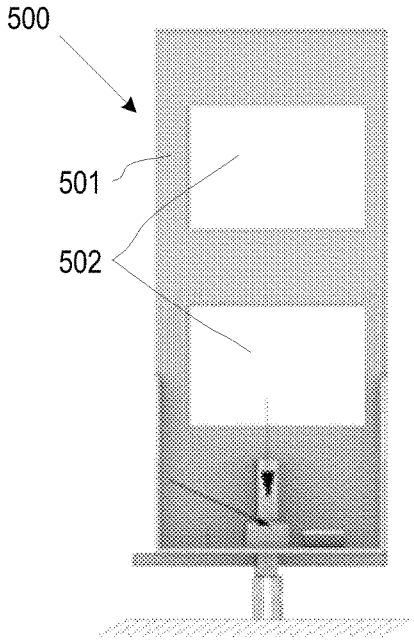
FIG. 10B is a side view of the lifting bracket of FIG. 10A.
Figure 11A:
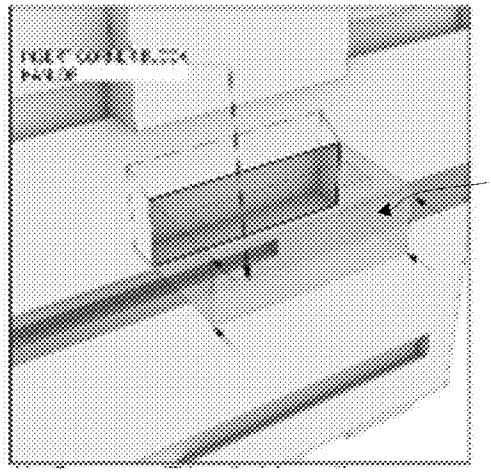
FIG. 11A is a magnified view of a corner block for a façade panel, according to at least one embodiment described herein.
Figure 11B:
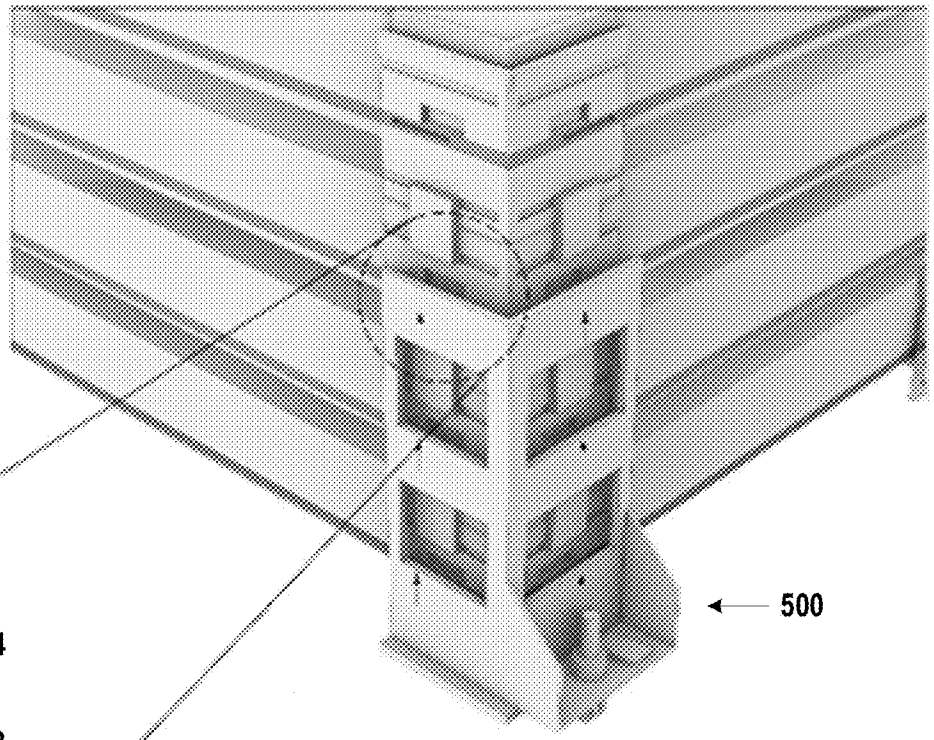
FIG. 11B is a perspective view of a lifting bracket coupled to a system for storing and transporting façade panels, according to at least one embodiment described herein.

FIG. 10A is a front perspective view of a lifting bracket 500 for use with the systems for storing and transporting façade panels described herein, according to at least one embodiment described herein. Lifting bracket 500 includes a body 501 having a L-shape that mimics the L-shape of corner bracket 100. Body 501 also includes a set of openings 502 that provide access to corner block 100 when the lifting bracket 500 is attached thereto. An example of how the openings 502 can provide access to corner block 100 when the lifting bracket 500 is attached to a stack of façade panels is shown in FIG. 11B. In the embodiment shown in the drawings, bracket 500 includes four openings 502.

Figure 11C:
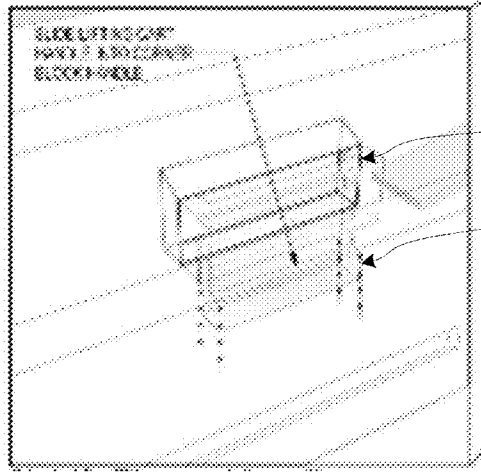
FIG. 11C is a magnified view of a portion of a corner block and the lifting bracket of FIG. 11B.

Body 501 also includes a set of lifting elements 503. For example, in the embodiment of lifting bracket 500 shown in the drawings, body 501 includes six lifting elements 503, three positioned on each portion of body 501. Each lifting element 503 is sized and shaped to enter a cavity defined by first protrusion 171 and/or second protrusion 174 of corner block 100 to be releasably coupled to a plurality of corner blocks 100. As shown in FIGS. 11A-C, lifting element 503 slides upwardly into a cavity formed by first protrusion 171 and/or second protrusion 174 of corner block 100. When the lifting bracket 500 is releasably coupled to a stack of façade panels having corner blocks thereon, lifting bracket 500 can provide for easily transporting the stack of façade panels.

Figure 10C:
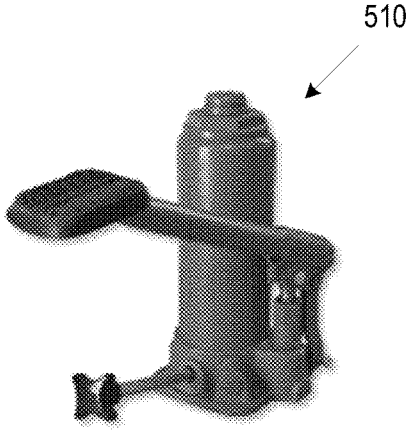
FIG. 10C is a perspective view of a lifting mechanism for use with the systems for storing and transporting façade panels described herein, according to at least one embodiment described herein.
Figure 10D:
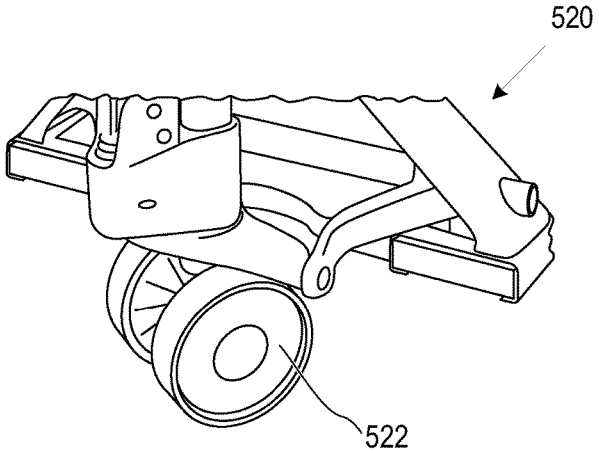
FIG. 10D is a magnified view of a portion of a lifting mechanism for use with the systems for storing and transporting façade panels described herein, according to at least one embodiment described herein.

In at least one embodiment, one or more bearing pads (not shown) may be positioned at a base of lifting bracket 500 for coupling a lifting mechanism, such as but not limited to lifting mechanism 510 shown in FIG. 10C, to lifting bracket 500. Lifting mechanism 510 may then be used to lift the lifting bracket 500, and the stack of façade panels coupled thereto. FIG. 10D is a magnified view of a portion of another lifting mechanism 520 having one or more sets of wheels 522 for use with the systems for storing and transporting façade panels described herein. In this embodiment, once the lifting mechanism 520 raises the stack of façade panels off of a ground the wheels 522 may provide for transporting the stack of façade panels along the ground.

Figure 12:
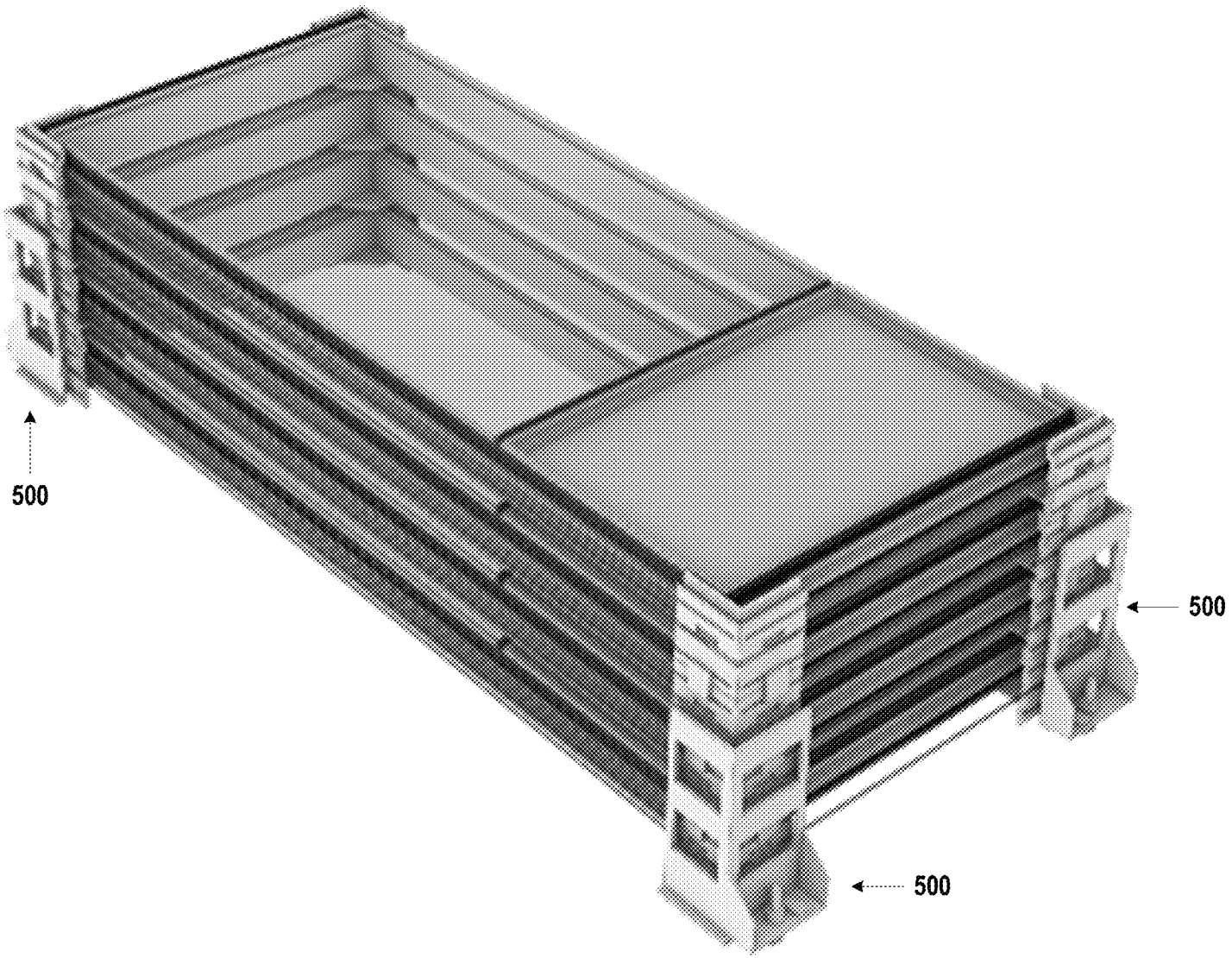
FIG. 12 is a perspective view of a bundle of four systems of façade panels with each corner of the bundle having a lifting mechanism releasable secured thereto.

FIG. 12 is perspective view of a stack of façade panels having a lifting bracket 500 releasably secured to each corner thereof.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A corner block for stacking façade panels, the corner block comprising:

a vertical wall having a first portion and a second portion, the second portion being orthogonal to the first portion and attached to the first portion at a joint, the first portion and the second portion combining to provide the vertical wall with an L-shape, each of the first portion and the second portion having a receiver at an uppermost edge thereof; and a support plate orthogonal to the first portion and the second portion of the vertical wall, the support plate extending outwardly from an inner surface of the first portion and an inner surface of the second portion, the support plate being spaced upwardly from a lowermost edge of the first portion and a lowermost edge of the second portion;

wherein, the receiver of the first portion includes:

a first inner member that extends outwardly in a first direction from the inner surface of the first portion to overhang at least a portion of the support plate; and a first outer member spaced apart from the first inner member in a direction opposite to the first direction to define a receiving space between the first inner member and the first outer member, the receiving space sized and shaped to receive the lowermost edge of the first portion of an adjacent corner block therein.

2. The corner block of claim 1, wherein the receiver of the second portion includes a second inner member that extends outwardly in a second direction from the inner surface of the second portion to overhang at least a portion of the support plate.

3. The corner block of claim 2, wherein the receiving space between the first inner member and the first outer member is positioned directly above the first portion of the vertical wall.

4. The corner block of claim 3, wherein the receiving space between the second inner member and the second outer member is positioned directly above the second portion of the vertical wall.

5. The corner block of claim 4, wherein a height of the first inner member of the first portion is greater than a height of the first outer member of the first portion.

6. The corner block of claim 5, wherein a height of the second inner member of the second portion is greater than a height of the second outer member of the second portion.

7. The corner block of claim 1, wherein at least one of the first portion and the second portion include an inner cavity extending inwardly from an opening in the inner surface thereof, the inner cavity being positioned above the support plate and extending laterally from an outer edge of the first portion or the second portion of the vertical wall towards the joint.

8. The corner block of claim 7, wherein the inner cavity is shaped as a slot that is parallel with an upper surface of the support plate.

9. The corner block of claim 7, wherein the inner cavity is defined by an inner surface spaced apart from the opening and at least a portion of the inner cavity between the opening and the inner surface has a cavity height that is greater than a height of the opening.

10. The corner block of claim 1, the first portion of the vertical wall includes a first inner cavity and the second portion of the vertical wall includes a second inner cavity, the first inner cavity extending inwardly from the inner surface of the first portion and the second inner cavity extending inwardly from the inner surface of the second portion, both of the first inner cavity and the second inner cavity being positioned above the support plate and extending laterally from an outer edge of the first portion and the second portion, respectively, towards the joint.

11. The corner block of claim 1, wherein at least one of the first portion and the second portion include a first outer cavity extending inwardly from a first opening in an outer surface thereof, the first outer cavity extending laterally from an outer edge of the first portion or the second portion of the vertical wall towards the joint.

12. The corner block of claim 11, wherein at least one of the first portion and the second portion include a second outer cavity extending inwardly from a second opening in an outer surface thereof, the second outer cavity extending laterally from an outer edge of the first portion or the second portion of the vertical wall towards the joint, the second outer cavity being vertically spaced apart from the first outer cavity.

13. The corner block of claim 12, wherein each of the first outer cavity and the second outer cavity is shaped as a slot that is parallel with an upper surface of the support plate.

14. The corner block of claim 13, wherein the first outer cavity is positioned above an upper surface of the support plate and the second outer cavity is positioned below the upper surface of the support plate.

15. The corner block of claim 11, wherein each of the first portion and the second portion include a first outer cavity extending inwardly from the first opening in the outer surface thereof and a second outer cavity extending inwardly from a second opening in the outer surface thereof, each of the first outer cavity and the second outer cavity extending laterally from an outer edge of the respective portion of the vertical wall towards the joint.

16. The corner block of claim 15, wherein at least one of the first portion and the second portion include a first protrusion extending outwardly from an outer surface thereof.

17. The corner block of claim 16, wherein the first portion includes a first protrusion extending outwardly from an outer surface of the first portion and the second portion includes a second protrusion extending outwardly from an outer surface of the second portion.

18. The corner block of claim 17, wherein each of the first protrusion is positioned between the first outer cavity and the second outer cavity of the first portion and the second protrusion is positioned between the first outer cavity and the second outer cavity of the second portion.

19. A system for stacking and/or transporting façade panels, the system including a plurality of the corner block of claim 1, each corner block of the plurality of corner blocks being positioned on a corner of a respective façade panel.

20. The system of claim 19 further comprising a cap configured to releasably attach to the receiver of at least one corner block of the plurality of corner blocks.

* * * * *